US005423096A

United States Patent [19]

Janisch

[11] Patent Number: 5,423,096

[45] Date of Patent: Jun. 13, 1995

[54] BATHTUB LIFT FOR HANDICAPPED PERSONS

[75] Inventor: Klaus Janisch, Isny, Germany

[73] Assignee: Schmidt & Lenhardt GmbH & Co. oHG, Isny, Germany

[21] Appl. No.: 260,115

[22] Filed: Jun. 15, 1994

[30] Foreign Application Priority Data

Jul. 17, 1993 [EP] European Pat. Off. ..... 93111498

[51] Int. Cl.[6] ..... A47K 3/12

[52] U.S. Cl. ..... 4/566.1

[58] Field of Search ..... 4/560.1, 564.1, 565.1, 4/566.1

[56] References Cited

U.S. PATENT DOCUMENTS 4,419,776 12/1983 Schmidt ..... 4/564.1

4,660,234 4/1987 Schmidt ..... 4/566.1

FOREIGN PATENT DOCUMENTS 0131741 1/1985 European Pat. Off. ..... 4/566.1

*Primary Examiner*—Charles E. Phillips

*Attorney, Agent, or Firm*—Notaro & Michalos

[57] ABSTRACT

Situated on the underside of a lifting plate 24 of a bathtub lift is a value housing 40 containing an inlet valve 48 and an outlet valve 50. Both valves 48, 50 are actuated as required by a joint rocker 76 which in turn in the event of non-actuation is held by the plungers of the two valves in its neutral position. Pressure applied to one end of the rocker 76 opens the inlet valve so that the lifting plate 24 of the bathtub lift is raised. When the rocker is released 76, the inlet valve 48 closes and when the other end of the rocker 76 is pressed the outlet valve opens causing water to be discharged from the lifting hose of the bathtub lift via an outlet opening 68 in the valve housing 42.

5 Claims, 4 Drawing Sheets

BATHTUB LIFT FOR HANDICAPPED PERSONS

BACKGROUND OF THE INVENTION

The invention concerns a bathtub lift with a lifting plate upwardly and downwardly guided on a support frame and actuated by a hydraulic lifting device, and a valve device featuring an inlet valve and an outlet valve whose valve plungers are actuatable as required by a hand-operated rocker, whereby the two valve plungers are of identical design, displaceably guided with parallel axes in a valve housing and preloaded in their closed position with inbuilt springs, and a connection leading to the lifting device is connected to an outlet opening when the outlet valve is open.

U.S. Pat. No. 3,280,409 shows such a bathtub lift. The valve device is positioned at the side and at a distance from the support frame and from the lifting plate. If the former is raised to its limit of travel, its upward motion is limited by an adjustable stop. The pressure in the hydraulic lifting device increases up to the supply pressure in the pressurized water line. The hydraulic lifting device is subjected to high load in the process.

EP Patent 00 74 460 shows a bathtub lift on which the lifting device consists of a flexible hose. If such hoses are subjected frequently and for extended periods to the full pressure of the water supply line, there is a risk of leakage.

U.S. Pat. No. 4,624,019 shows a lifting appliance with a metal lifting cylinder. A three-way valve positioned at a distance from the lifting plate is actuated by a hand-operated pivoted lever acting upon a Bowden cable. At its limit of travel, another Bowden cable draws an actuating rocker of the three-way valve towards another actuation position so that the lifting cylinder is disconnected from the pressurized water supply; the discharge valve, however, is opened as a result and the lifting plate descends.

SUMMARY OF THE INVENTION

The object of the invention is to improve a bathtub lift with a valve device of the type described above in such a way that the inlet valve automatically closes at precisely the lifting plate's limit of travel without affecting the outlet valve.

According to the invention, the valve device is fastened beneath the lifting plate and the rocker rests in a recess in the lifting plate and projects slightly above its upper face; at the valve plunger of the inlet valve a lifting element engages which, at the lifting plate's limit of travel, cooperates with a control arm displaceably guided beneath said lifting plate and lifts the valve plunger into its valve closed position whereby the motion of the control arm is derived from that of the support frame featuring two scissor frames.

The rocker does not require a spring means of its own to preload it towards its neutral position because the two valve springs effect this automatically. Thanks to the positioning of the valve device on the underside of the lifting plate, it is possible to move the inlet valve into its closed position by means of a simple mechanical connection between a scissor frame of the support frame and the valve device when the support frame reaches its limit of travel. The pressure in the lifting device then has precisely the value corresponding to the load of the lifting plate which is well below the pressure in the water supply line. In accordance with the invention, the inlet valve is closed with a position-dependent mechanism; a particularly beneficial feature is the extremely short stroke of the valve plunger of less than 2 mm. Any play in the motion of the rocker cannot have any effect on this automatic closure of the inlet valve.

In accordance with an embodiment of the invention, the outlet valve is at the same time a safety valve for limiting the pressure in the lifting device. When the lifting support frame reaches its limit of travel defined by the stop, the pressure in the lifting device rises. At a value beneath the water line pressure, though above the pressure needed for lifting heavy persons, the outlet valve opens as the spring is selected for this pressure value. As soon as the pressure falls below this value, the outlet valve closes. Even in the event of failure of the position-dependent closure of the inlet valve, only a limited pressure can build up in the lifting device.

BRIEF DESCRIPTION OF THE DRAWING

It shows.

DETAILED DESCRIPTION

Figure 1:
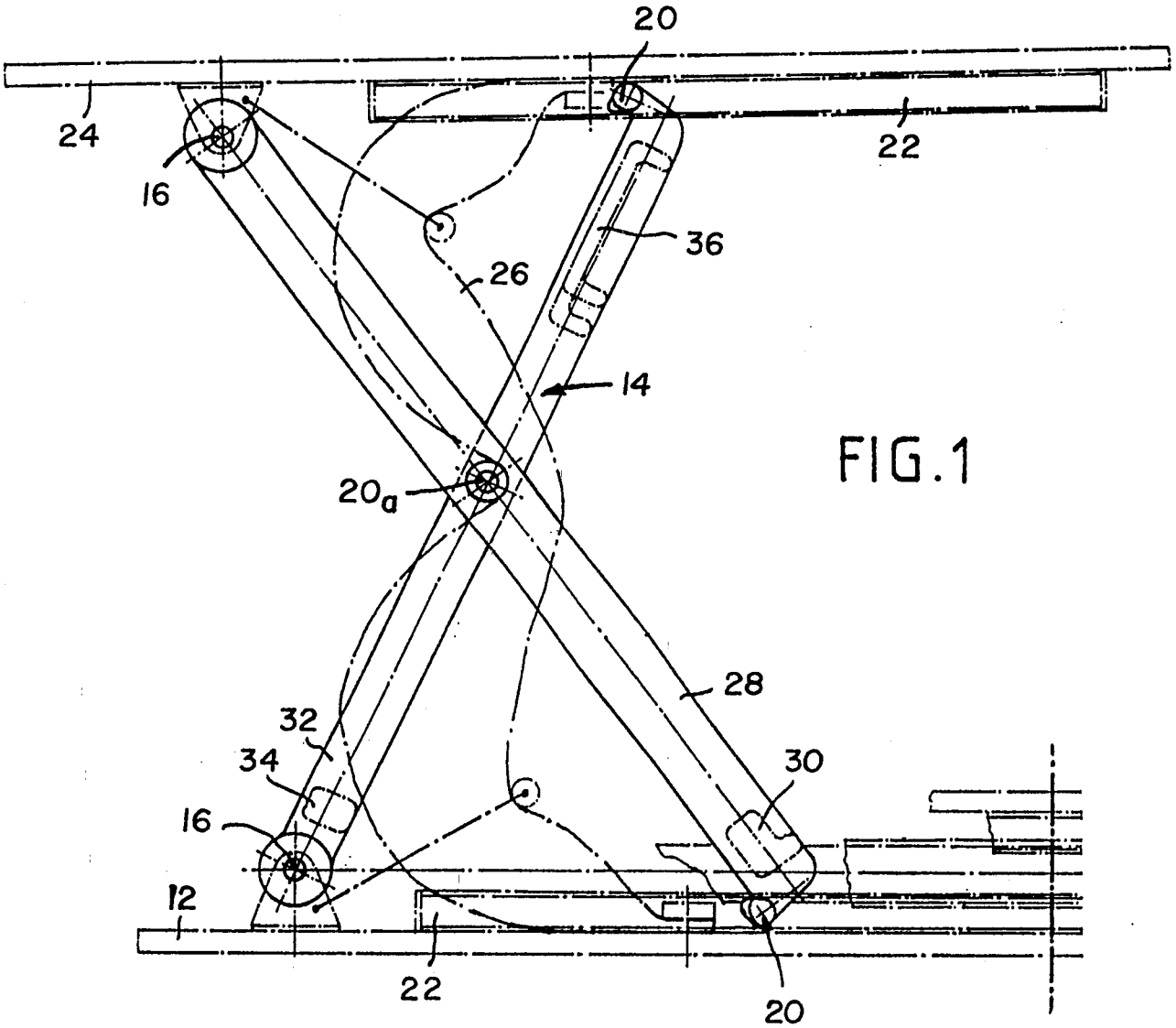
FIG. 1 a side view of the bathtub lift.

The basic design of the bathtub lift is shown in FIG. 1. Resting on a base plate 12 is a support frame 14 featuring two scissor frames 28, 32 whereby the inner scissor frame 32 is rotatably guided about two fixed rotary bearings 16 on the base plate and the outer scissor frame 28 features two slide bearings 20 which are displaceably guided in guide rails 22 on the base plate 12. The two scissor frames 28, 32 are connected together at their mid-length positions by a joint rotary bearing 20. The support frame 14 supports a lifting plate 24 on the underside of which two fixed rotary bearings 16 are provided for the outer scissor frame 28 as well as two guide rails 22 in which the slide bearings 20 of the inner scissor frame 32 are longitudinally displaceable. At its base, the outer scissor frame 28 has a cross strut 30 and the inner scissor frame has a bottom cross strut 34 and a top cross strut 36. The two scissor frames each consist of single-piece moulded plastic parts. A lifting hose 26, which is closed at its two ends, is attached with its bottom end to the base plate 12 and clamped with its top end to the underside of the lifting plate 24.

Figure 4:
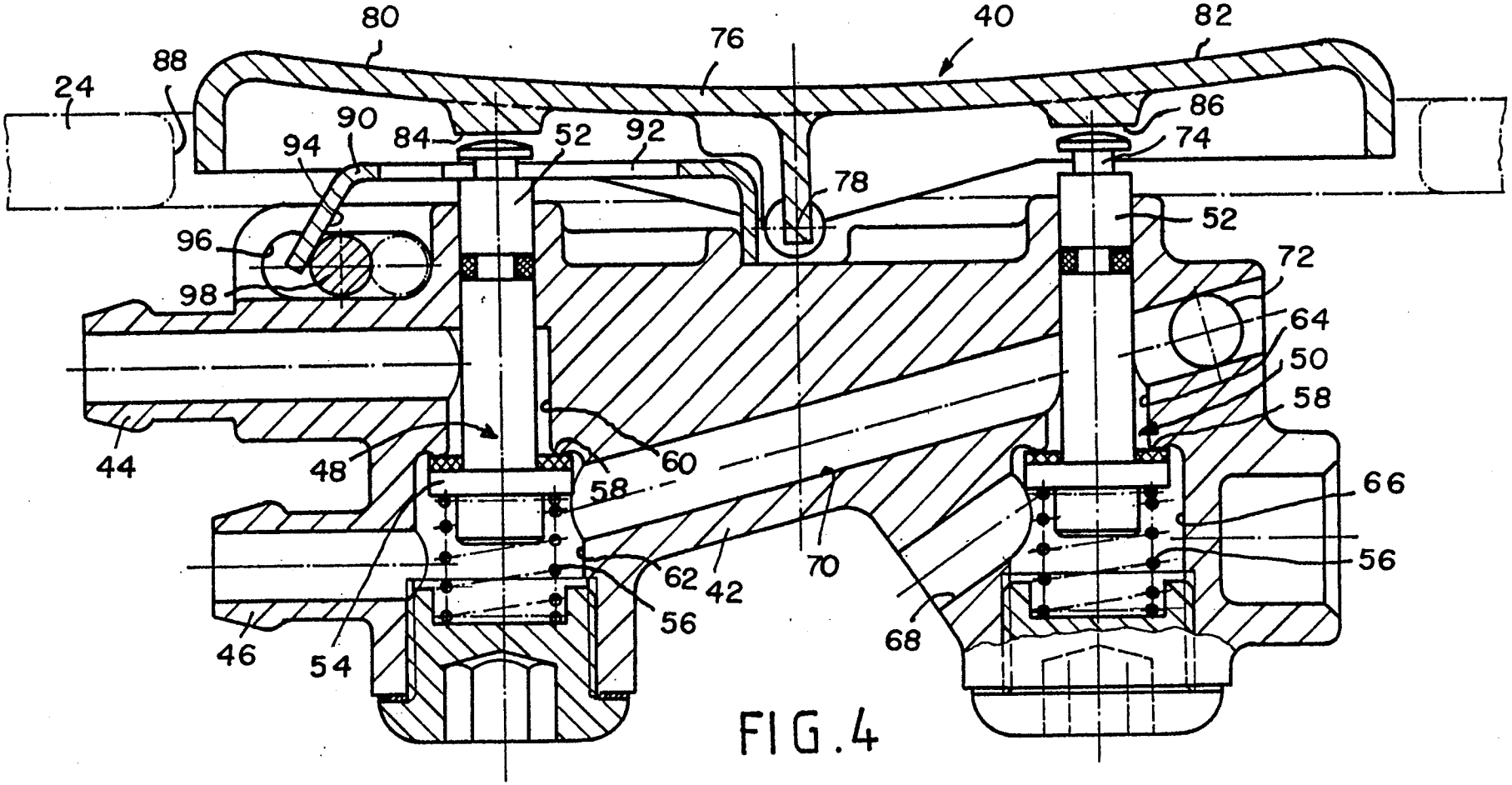

Near to the outer edge of the lifting plate 24 is a valve device 40 which is screwed onto the underside of the lifting plate 24. The valve housing 42 of the valve device 40 features a connecting sleeve 44 to which a pressurized water supply hose is connectable. Perpendicularly beneath the connecting sleeve 44 is another connecting sleeve 46 to which a hose leading to the lifting hose 26 can be attached. As is shown particularly by FIG. 4, the valve housing 42 contains an inlet valve 48 and an identically designed outlet valve 50. Each of the two valves 48, 50 features a valve plunger 52 which is displaceably guided with a vertical axis in a stepped borehole in the valve housing 42, features a valve plate 54 with a ring seal close to its bottom end and is preloaded by a helical spring 56 against a valve seat 58. Above the valve seat 58, a first annular chamber 60 is formed into which the borehole of the connection 44 opens. Situated beneath the valve seat 58 is a second, in diameter slightly larger, annular chamber 62 into which the borehole of the connection 46 opens.

The outlet valve 50 contains a first annular chamber 64 above the valve seat 58 and, downstream from the valve seat 58, a second annular chamber 66 containing the valve spring 56. A downwardly inclined vent hole with outlet opening 68 opens into this second annular chamber 66. The bottom annular chamber 62 of the inlet valve 48 is connected via an upwardly inclined borehole 70 to the upper annular chamber 64 of the outlet valve 50. The axis of the borehole is situated in the central vertical longitudinal plane of the valve housing 42 and intersects the axes of the two valve plungers 52. The upper end of the connecting borehole 70 is closed by a threaded stopper, as shown schematically at 72.

The two valve plungers 52, whose axes are vertical and parallel, project from the top of the valve housing 42 and feature a neck-like constriction 74 beneath the plunger head. A rocker 76 is rotatably mounted about a transverse axis 78 on the valve housing 42 on the top in a middle transverse plane at equal longitudinal distances from the two valve plungers 52. On the top, the rocker 76 has two pushbutton fields 80, 82 which merge into one another on a continuous curve. On the underside of the rocker 76 are two projections with actuation faces 84, 86 which are positioned close to the heads of the valve plungers 52 when the rocker 76 is in its neutral position shown in FIG. 4. The lifting plate 24 features a rectangular recess 88 for the rocker 76 so that the rocker 76 only projects slightly above the upper face of the lifting plate 24.

If the user of the bathtub lift presses the pushbutton field 80 of the rocker 76, the valve plunger 52 is displaced downwards and the connecting sleeve 46 leading to the lifting hose 26 communicates with the connecting sleeve 44 leading to the pressurized water supply with the result that the lifting hose 26 is filled with water and the lifting plate 24 is raised. If the user releases the rocker 76, the valve spring 56 causes the inlet valve 48 to close whereby the valve plunger 52 returns the rocker 76 to its neutral position. If the user now presses the pushbutton field 82 of the rocker 76, the outlet valve 50 opens and the lifting hose 26 is drained via the housing borehole 70 and the two annular chambers 64, 66 of the outlet valve 50 whereby the water is discharged via the outlet opening 68.

In a simple embodiment, the two rails 22 of the lifting plate 24 and/or the rails 22 of the base plate 12 are equipped with a plastic element against which the respective slide bearings 20 of the scissor frames 32 and 28 abut when the lifting plate 24 reaches its limit of travel. The water pressure, possibly reduced by a pressure reduction valve, then builds up in the inlet valve 48 on either side of the valve seat 58 so that the valve spring 56 closes the inlet valve.

The outlet valve 50 is also preferably designed as an excess pressure valve whereby the strength of the valve spring 56 must be dimensioned such that the valve 50 opens to reduce the pressure in the lifting hose 26 if the adjustable working pressure ranging from approximately 3 to 6 bar is fallen short of.

Figure 2:
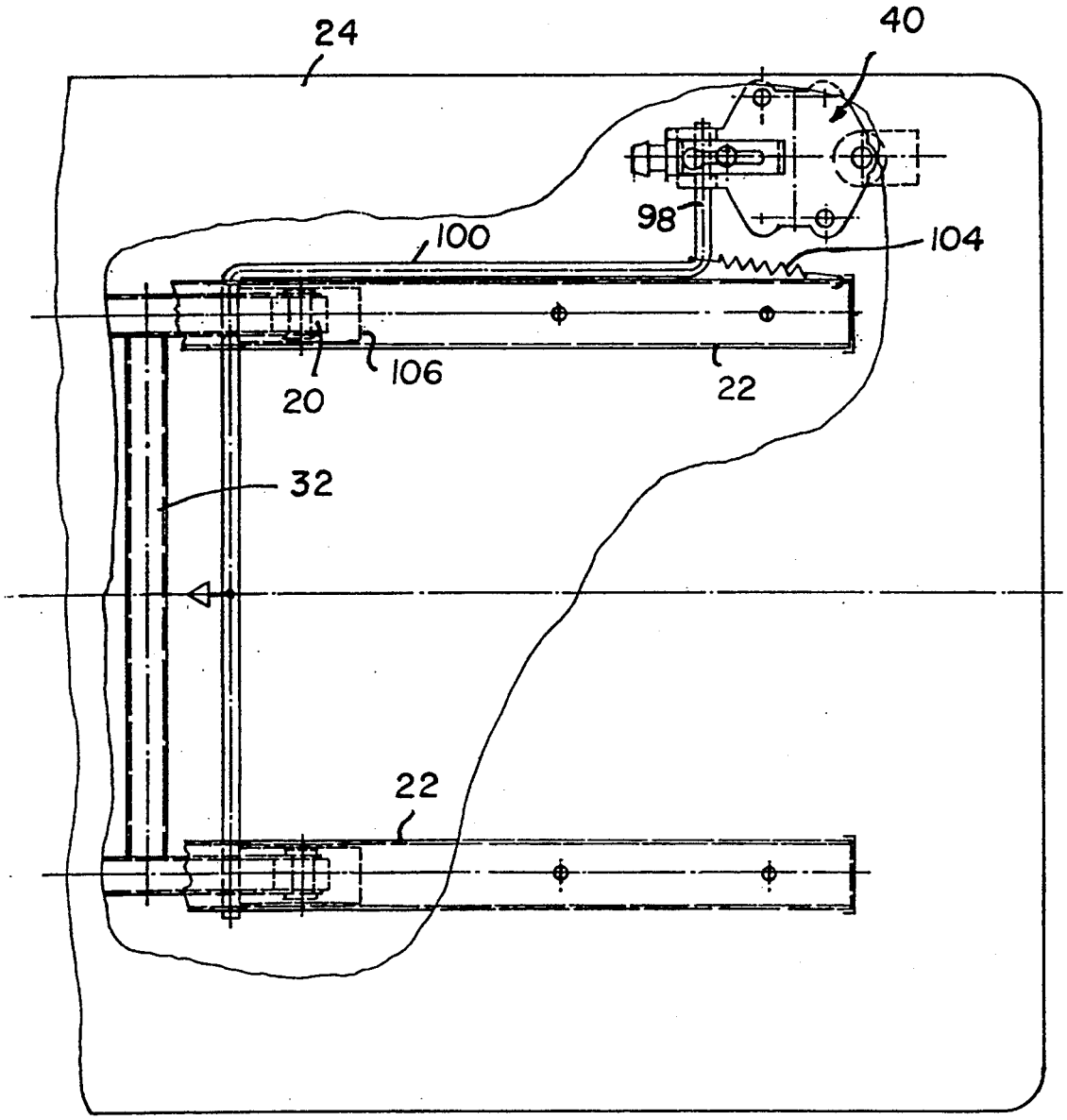
FIG. 2 a top view of a detail of the lift showing the guide support frame in the lifting plate's uppermost position, FIG. 3 a partially sectional side view of the valve device beneath the lift's lifting plate, and FIG. 4 a vertical section through the valve device.
Figure 3:
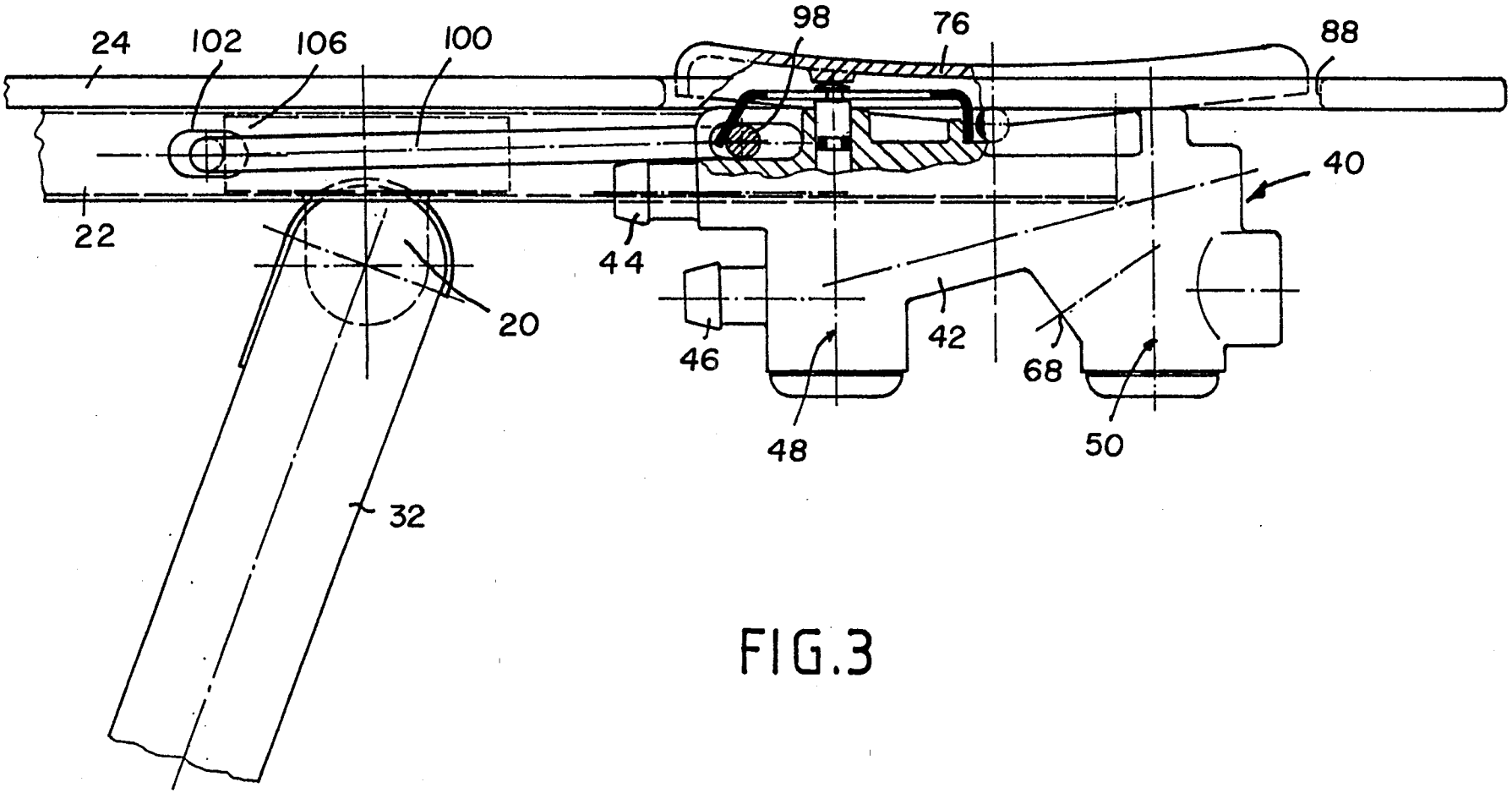

Instead of rigid mechanical stops, compressible plastic bodies can be fitted in the rails 22 so that the motion of the lifting plate 24 is damped on reaching its limit of travel. With a simple piece of additional equipment, a position-dependent closure of the inlet valve 48 can be achieved. To this end, a hand-operated pivoted lever 90 is employed which features in its central area a longitudinal slot 92 with an insertion opening and in which the neck-like constriction 74 of the valve plunger 52 of the inlet valve 48 engages. This pivoted lever 90 is therefore supported by the valve plunger 52 of the inlet valve 48 with low vertical play. The two ends of the pivoted lever 90 are bent downward, with the right-angled bend serving as the pivotal bearing of the pivoted lever 90 on the valve housing 42. This right-angled bend is situated between the transverse axis 78 of the rocker 76 and a projection on the upper face of the valve housing 42. The other end of the pivoted lever 90 is provided with a face 94 at an angle of approximately 60° from the horizontal. This angled end of the pivoted lever 90 is positioned between two side wall parts featuring horizontal longitudinal holes 96 penetrated by the right-angled piece 98 of a bar 100. In the two rails 22 of the lifting plate 24 are two transversely aligned longitudinal holes 102 which are penetrated by the bar 100. A spring 104 (FIG. 2) draws the bar 100 to one set of ends of the longitudinal holes 102. The right-angled bend 98 then adopts the position indicated by a broken line in FIG. 4 and is thus positioned at the end of the longitudinal holes 96. If the slide bearing 20 of the scissor frame 32 in the rails 22 now reaches a position shortly before the lifting plate's 24 limit of travel, the sliding piece 106 guided in the rails 22 makes contact with the bar 100. The bar 100 is displaced a few millimeters in a longitudinal direction against the action of the readjusting spring 104. In the process, the right-angled piece 98 comes into contact with the angled face 94 of the pivoted lever 90 and, in the event of a further displacement of the bar 100, the pivoted lever 90 is pivoted upward so that the valve plunger 52 of the inlet valve 48 is drawn into its closed position. The pivoted lever 90 thus acts here as a lifting element in closing the inlet valve 48 with a position-dependent mechanism even when the user presses the "down" pushbutton field of the rocker 76.

The described limit-of-travel closure is extremely precise because it acts directly upon the valve plunger 52, thus eliminating the influence of any play of the rocker 76. The necessary stroke of the two valve plungers 52 is extremely short and is in practice less than 2 mm.

The last-mentioned, position-dependent actuation of the inlet valve 48 can be employed instead of a mechanical stop in the rails 22 and in addition to such stops, particularly if they are designed as dampers.

What is claimed is:

1. A user lifting apparatus for use in a bathtub comprising: a lifting plate upon which a user is supported, said lifting plate being upwardly and downwardly guided on a support frame which rests on a bathtub, said lifting plate being actuated by a hydraulic lifting device including a valve device featuring an inlet valve and an outlet valve each having a valve plunger which is actuatable as required by a hand-operated rocker, each valve plunger being displaceably guided along generally parallel axes in a valve housing and each being spring biased in its closed position, a fluid connection leading to the lifting device is connected to an outlet opening when the outlet valve is open, the valve device is fastened beneath the lifting plate and the rocker rests in a recess in the lifting plate and projects slightly above the upper surface of said lifting plate, the valve plunger of the inlet valve being engaged by a pivoted lever displaceably guided beneath said lifting plate which lifts the plunger of the inlet valve into its valve closed position when a limit of travel of said lifting plate is reached.

2. An apparatus as claimed in claim 1, including a bar capable of displacement parallel to the plane of the lifting plate when engaged by a slide bearing displaceably guided along the lifting plate and belonging to a scissor frame of the support frame, when the slide bearing is near to the lifting plate's limit of travel, and a 90° motion converter between the pivoted lever and the bar so that a motion of the bar parallel to the lifting plate is converted into lifting of the pivoted lever.

3. An apparatus as claimed in claim 2, wherein the pivoted lever is pivotally supported at one end adjacent a transverse axis of the rocker and features at the other end, an angled face which cooperates with the bar.

4. An apparatus as claimed in claim 3, wherein the valve plunger of the inlet valve features, outside the valve housing, a neck-like constriction which is held in a slot of the pivoted lever.

5. An apparatus as claimed in claim 1, wherein the spring bias of the plunger of the outlet valve is selected to be overcome by an excess pressure within a range of 3–6 bar.

* * * * *